US005279340A

United States Patent [19]

Scherr et al.

[11] Patent Number: 5,279,340

[45] Date of Patent: Jan. 18, 1994

[54] BALLOON STUFFING DEVICE

[75] Inventors: Mark J. Scherr, Mequon; Michael Mitten, Milwaukee, both of Wis.

[73] Assignee: Innovations Sensations Incorporated, Mequon, Wis.

[21] Appl. No.: 905,108

[22] Filed: Jun. 26, 1992

[51] Int. Cl.[5] ..... B65B 43/36

[52] U.S. Cl. ..... 141/313; 141/114; 141/67; 222/631; 53/258; 53/434; 53/390; 53/469; 53/570; 53/385.1; 446/220

[58] Field of Search ..... 141/10, 37, 67, 68, 141/114, 313-317; 53/258, 260-317, 258, 260-263, 385.1, 390, 434, 459, 469, 473, 474, 570, 417/467; 137/223, 268; 446/220-; 222/631, 632

[56] References Cited

U.S. PATENT DOCUMENTS

| | | | |
|---|---|---|---|
| 2,695,741 | 11/1954 | Haley | 141/314 |
| 4,737,133 | 4/1988 | Neumeier | 446/397 |
| 4,809,483 | 3/1989 | Lovik | 53/434 |
| 4,809,484 | 3/1989 | Lovik | 53/434 |
| 4,811,841 | 3/1989 | Domenichiello | 206/423 |
| 4,878,335 | 11/1989 | Hardy | 53/434 |
| 4,924,919 | 5/1990 | Oyler | 141/10 |
| 4,955,412 | 9/1990 | Younts et al. | 141/114 |
| 4,970,844 | 11/1990 | Domenichiello | 53/433 |
| 4,974,393 | 12/1990 | Rich et al. | 53/433 |
| 5,033,256 | 7/1991 | Rupp | 53/570 |
| 5,051,073 | 9/1991 | Newbold | 417/526 |
| 5,054,273 | 10/1991 | Schmitt | 53/564 |
| 5,088,267 | 2/1992 | Gee | 53/86 |

OTHER PUBLICATIONS

"The Keepsake Stuffer" by M. K. Brody Co., Inc., Chicago, Illinois.

Qualatex "Stuffun Wrap" Manual, by Lovik Enterprises, 1989.

*Primary Examiner*—J. Casimer Jacyna

*Attorney, Agent, or Firm*—Andrus, Sceales, Starke & Sawall

[57] ABSTRACT

The manually-operated balloon stuffing device has a minimum number of parts and is inexpensive to manufacture. The device includes a manual pump consisting of inner and outer cylindrical tubes, and a check valve in each tube that permits the passage of air in only a single direction within its respective tube. In a first embodiment, a balloon stuffing item is placed in an end of the inner tube, and the open balloon end is stretched over that tube end. The outer tube is then reciprocated along the longitudinal axis of the inner tube to pump up the balloon. The outer tube is then removed and a push rod pushes the sliding check valve, which in turn pushes the stuffing item into the inflated balloon. In an alternate embodiment, a large hollow adapter tube is placed on the end of the inner tube, and the open end of the balloon is stretched over the open end of the adapter tube. After the balloon is inflated, a push rod pushes the sliding check valve, which in turn pushes an extension rod, the latter moving the stuffing item into the balloon. In yet a third embodiment, the need for a push rod and a slidable check valve is eliminated by using a connector between the tube in which the item is placed on the upper end of the inner tube. Once the balloon is inflated as before, the inner tube is pushed through the third hollow tube, thereby pushing the item into the balloon.

10 Claims, 3 Drawing Sheets

BALLOON STUFFING DEVICE

BACKGROUND OF THE INVENTION

This invention relates to devices for placing an item inside of an inflated balloon. More particularly, this invention relates to manually-operated balloon stuffing devices.

Several devices are known for placing an item within an inflated balloon. The balloon stuffing item may be a stuffed animal, flowers, or other novelty items. Many of the prior art balloon stuffing devices require an electrical power source to operate the air compressor used to inflate the balloon. These devices are complicated and expensive, and are limited to use in locations having a ready source of electrical power.

Other prior art devices use manually-operated pumps instead of an electrical pump to inflate the balloon. However, these devices are also expensive to manufacture since they are complicated, have numerous component parts, and require many manufacturing steps.

It is therefore desirable to provide an inexpensive, manually-operated balloon stuffing device containing a small number of parts which may be used in any location.

SUMMARY OF THE INVENTION

A balloon stuffing device is disclosed having a manually-operated pump consisting of two concentric hollow cylinder members and two check valves, and a means for pushing a balloon stuffing item disposed in the inner hollow member or in a third hollow cylinder member into the inflated balloon.

In a first embodiment, the balloon stuffing device includes an inner hollow cylindrical member having a first end adapted to receive a balloon stuffing item therein, an outer hollow cylindrical member that receives a portion of the inner hollow member, a sliding valve attached to a third hollow cylindrical member that is disposed and movable within the inner hollow member, a second check valve interconnected with an end of the outer hollow member, and a means for moving the sliding valve within the inner hollow member to thereby push the item into the inflated balloon.

A larger-diameter hollow adapter member may be used to place larger items into the inflated balloon. This adapter member is interconnected with an end of the inner hollow member and receives the balloon stuffing item. This embodiment includes an extension member disposed in the inner hollow member and in the hollow adapter between the sliding valve and the balloon stuffing item. After the balloon has been inflated by axially moving the outer hollow member with respect to the inner hollow member, a push rod pushes the sliding valve against the extension member, which in turn pushes the balloon stuffing item into the inflated balloon. The end of the balloon is then tied.

In yet another embodiment, the manually-operated pump includes an inner hollow member and an outer hollow member as in the other embodiments, a check valve within the inner hollow member, and a second check valve disposed on an end of the outer hollow member. This embodiment includes a third hollow member having a larger diameter than the inner or outer hollow members. The third hollow member is adapted to receive the balloon stuffing item. One end of the third hollow member has the open end of the balloon stretched over it. The other end of the third hollow member is connected to the inner hollow member by a substantially hollow connector. The connector preferably includes an externally-threaded first connector member, an internally-threaded second connector member adapted to be screwed onto the first connector member, and a flexible air seal that engages the first connector member and the second connector member.

The operation of this embodiment is as follows. The stuffing item is placed within the third hollow member. The open end of the balloon is stretched over the open end of the third hollow member. The outer hollow member is reciprocated or moved in the axial direction with respect to the inner hollow member to pump ambient air through the two check valves into the balloon. The check valves also prevent air from escaping from the device. Once the balloon has been inflated, the second connector member may be partially unscrewed from the first connector member. The inner hollow member is then pushed through the hollow connector and into the third hollow member, thereby pushing the item into the inflated balloon. The end of the balloon is then tied.

It is a feature and advantage of the present invention to provide a manually-operated balloon stuffing device having a minimum number of parts.

It is another feature and advantage of the present invention to provide a balloon stuffing device that does not require any electrical power source.

It is yet another feature and advantage of the present invention to provide an inexpensive balloon stuffing device that may be operated by the average consumer in any location.

These and other features and advantages of the present invention will be apparent to those skilled in the art from the following description of the preferred embodiments and the drawings, in which:

DETAILED DESCRIPTION OF THE PREFERRED EMBODIMENTS

Figure 1:
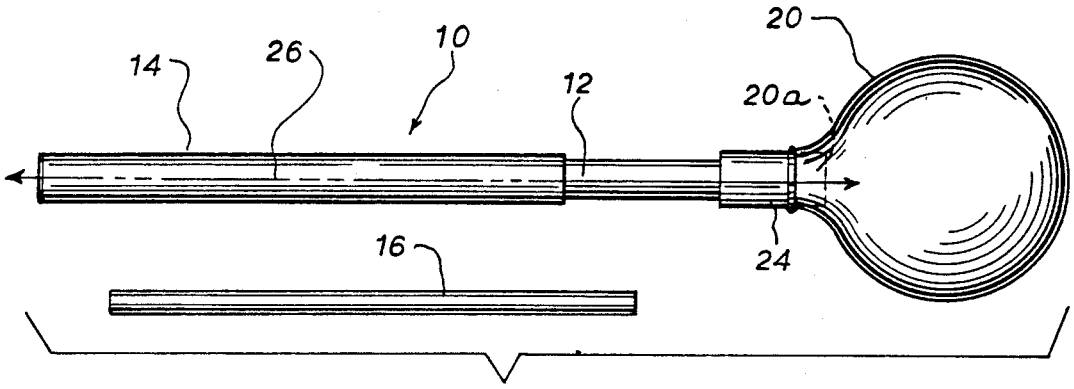
FIG. 1 is a side view of a first embodiment of the balloon stuffing device according to the present invention.

FIG. 1 is a perspective view of a first embodiment of the present invention. In FIG. 1, balloon stuffing device 10 includes an inner hollow member 12, an outer hollow member 14 adapted to receive at least a portion of inner member 12, and a push rod 16 that is used to move the balloon stuffing item 18 (FIG. 2) into inflated balloon 20 as described below. An open end 20*a* of balloon 20 is stretched or otherwise received over an end 24 of inner hollow member 12. Outer member 14 is reciprocated along longitudinal axis 26 of inner member 12 to pump air into balloon 20.

The internal components and operation of device 10 are best understood with reference to FIGS. 2 through 5. In FIGS. 2 through 5, inner member 12 has a space 12*a* therein adapted to receive a hollow member 28. Member 28 has a one-way check valve 30 interconnected with one of its ends. Hollow member 28, like inner member 12 and outer member 14, is preferably substantially cylindrical in shape, although other shapes may be used as long as the shapes of all three members 12, 14, and 28 substantially correspond to each other. Instead of member 28 being a hollow tube, member 28 may be an O-ring, it may have another configuration, or perhaps member 28 may be dispensed with altogether as long as valve 30 is slidable along inner surface 12*b* of inner member 12 without significant air gaps between check valve 30 and inner surface 12*b*.

Similarly, inner surface 14*a* of outer member 14 must be designed such that it slides along outer surface 12*c* of inner member 12 without any significant air gaps between inner surface 14*a* and outer surface 12*c*.

Both ends 12*d* and 12*e* of inner member 12 are open. End 12*d* receives ambient air passing through a second one-way check valve 32 attached to end 14*b* of outer tube 14. Outer member 14 is designed to be reciprocated in a direction parallel to longitudinal axis 26 (FIG. 1) of inner member 12.

Before the device is operated, item 18 is placed in space 12*a*. Then, open end 20*a* of balloon 20 is stretched over end 12*e* of inner member 12.

When outer member 14 is moved in a direction away from end 12*e* of inner member 12, air passes through check valve 32, and into air space 15 within outer member 14. Air pressure in space 12*a*, in member 28, and in balloon 20 keep check valve 30 closed so that the balloon does not deflate.

On the opposite, pumping stroke when member 14 moves in a direction toward end 12*e*, air is pumped from air space 15 through check valve 30, through hollow member 28, through space 12*a*, through open end 12*e*, and into open end 20*a* of balloon 20. Check valve 30 prevents air trapped in the device, in balloon 20, and in space 12*a* from escaping device 10. This repeated pumping action forces air into balloon 20 to inflate the balloon.

Figure 3:
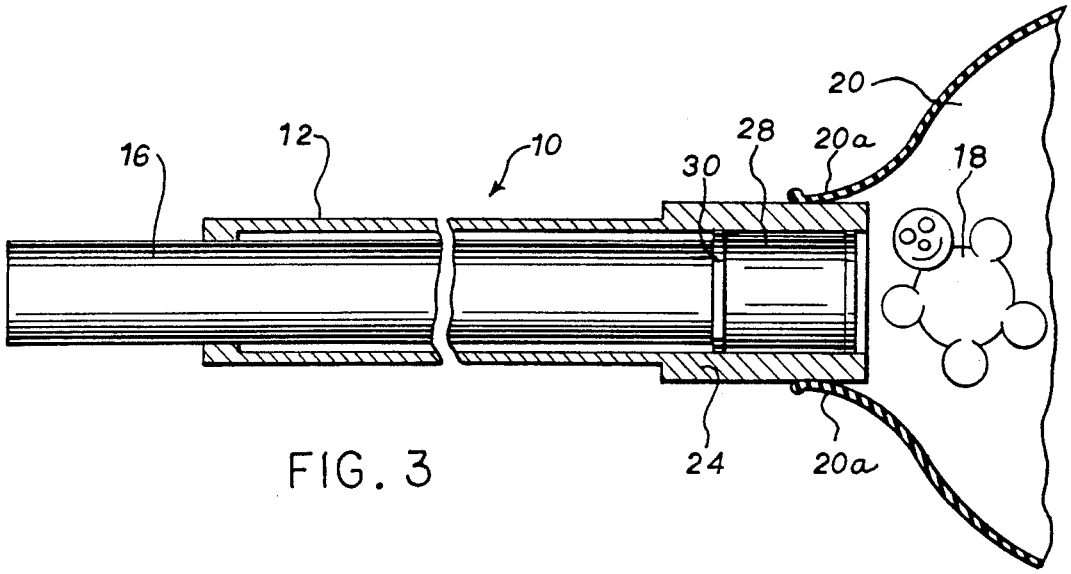
FIG. 3 is a side view, shown in partial section, of the first embodiment when the balloon stuffing item being pushed into the inflated balloon.

After balloon 20 has been inflated as depicted in FIG. 3, outer member 14 is removed from device 10 and a push rod 16 is thrust into inner member 12. The push rod abuts and pushes check valve 30 and hollow member 28 until member 28 has pushed item 18 into inflated balloon 20. Open end 20*a* is then tied to trap the air and item 18 in balloon 20.

Figure 4:
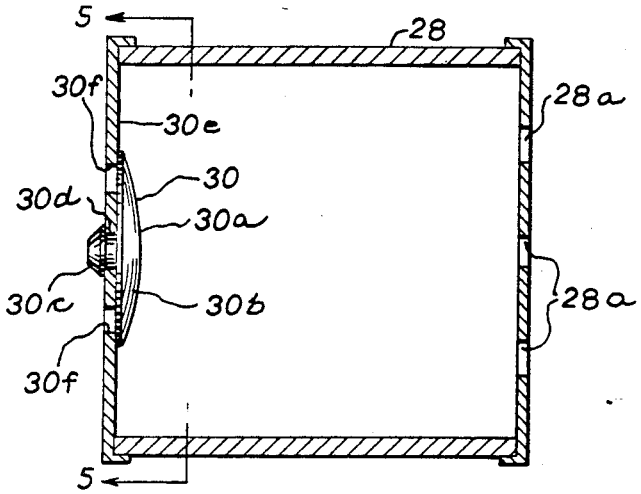
FIG. 4 is a side view, shown in partial section, of the sliding check valve assembly according to the present invention.
Figure 5:
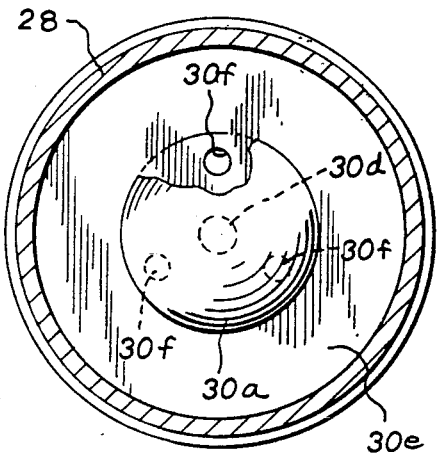
FIG. 5 is a top view, shown in partial section, of the sliding check valve of FIG. 4, taken along line 5—5 of FIG. 4.

FIGS. 4 and 5 more particularly depict hollow member 28 and check valve 30 interconnected thereto with As best shown in FIG. 4, check valve 30 includes a rubber button 30*a* having a tapered, substantially circular top portion 30*b* and a connecting knob 30*c* which is pressed through aperture 30*d* in end wall 30*e*.

As best shown in FIG. 5, end wall 30*e* has apertures 30*f* disposed in a triangular pattern about central aperture 30*d*. During the pumping stroke of the manual pump, ambient air moves freely through apertures 30*f*, through hollow member 28, and out apertures 28*a* of member 28. During the non-pumping stroke of the pump when outer member 14 is moved away from open end 12*e* (FIG. 2), valve 30 is closed since the air pressure within space 12*a*, in member 28 and in balloon 20 forces valve top 30*a* against apertures 30*f*, thereby preventing air from escaping balloon 20, space 12*a* and member 28.

Figure 2:
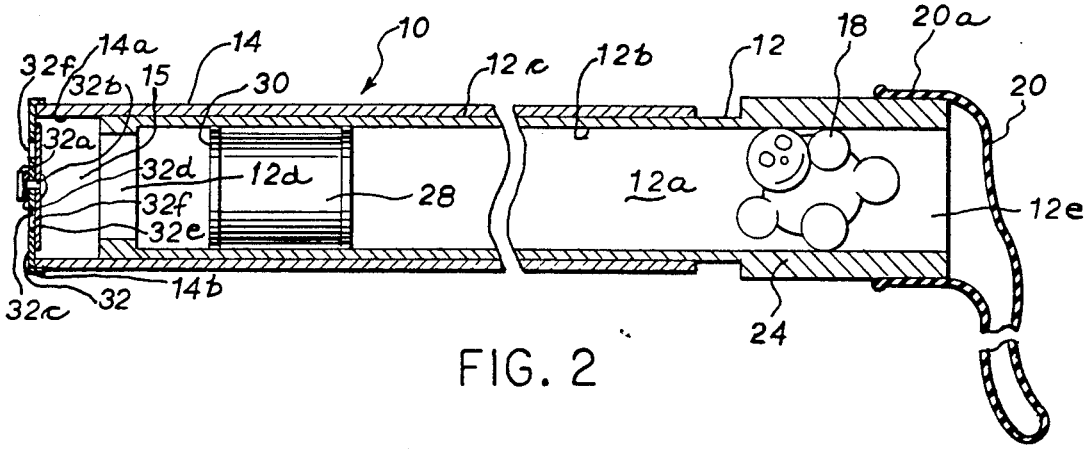
FIG. 2 is a side view, shown in partial section, of the first embodiment before the balloon has been inflated.

The design of check valve 30 depicted in FIGS. 4 and 5 is the preferred embodiment of the valve since it is simple and the least expensive to manufacture and assemble. However, other valves may be used for check valve 30, such as a design similar to check valve 32 depicted in FIG. 2. Other types of valves may also be used. In FIG. 2, check valve 32 includes a rivet 32*a* disposed within an aperture 32*b* of end wall 32*c*. A washer 32*d* is disposed between the outer end of rivet 32*a* and end wall 32*c*. The inner end of rivet 32*a* captures a rubber diaphragm member 32*e* between the inner rivet end and end wall 32*c*. End wall 32*c* has a plurality of apertures 32*f* therein which allow for the passage of ambient air into outer member 14.

Check valve 32 operates in a similar manner to check valve 30. During the non-pumping stroke of the manual pump, ambient air flows through apertures 32*f*, past rubber diaphragm member 32*e* and into outer member 14. During the pumping stroke of the device, the air pressure of the air within outer member 14 forces diaphragm member 32*e* against apertures 32*f*, thereby preventing air from escaping outer member 14 through valve 32.

Figure 6:
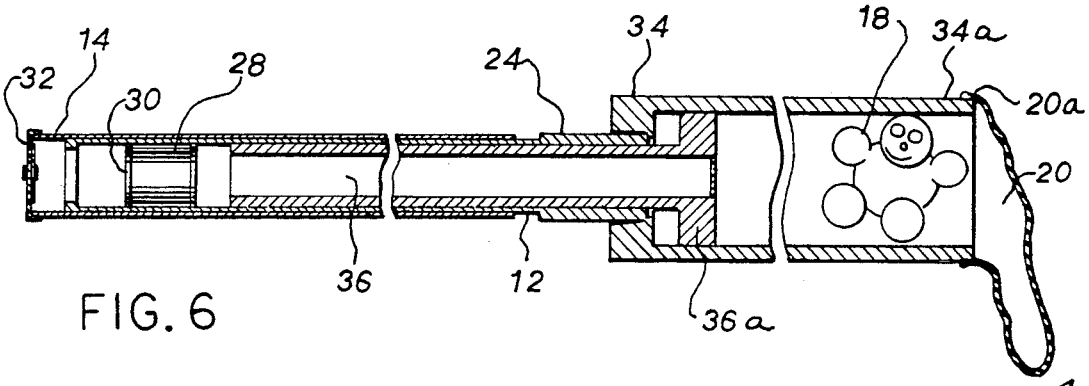
FIG. 6 is a side view, shown in partial section, of a second embodiment which includes a large adapter member for inserting larger items into a balloon.
Figure 7:
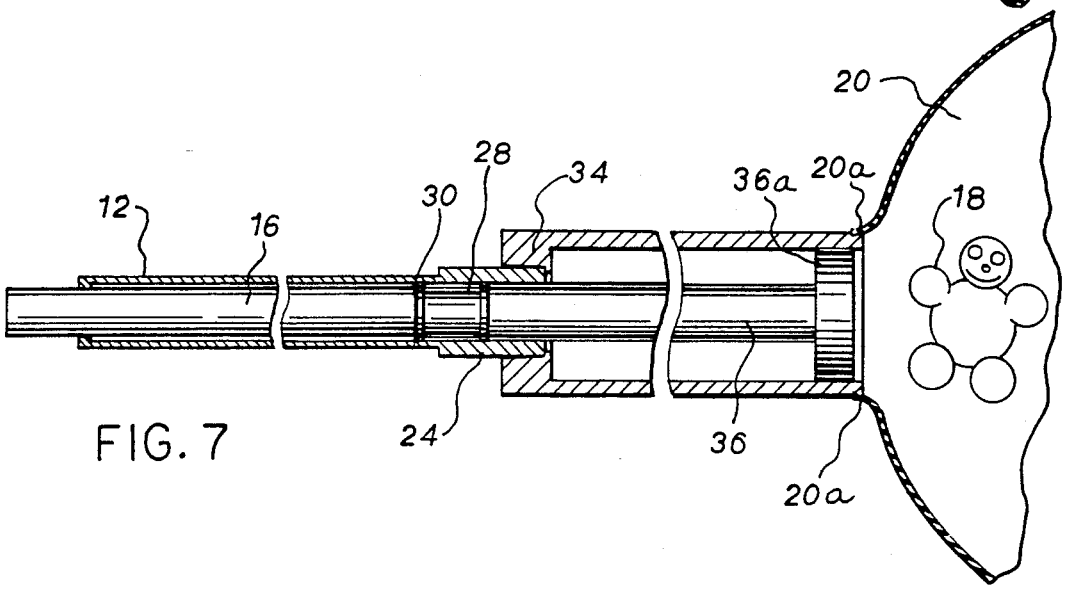
FIG. 7 is a side view, shown in partial section, of the embodiment of FIG. 6 in which the item is being inserted into an inflated balloon.

FIGS. 6 and 7 depict a second embodiment of the present invention that is used to insert larger items 18 into the balloon. In the embodiment depicted in FIGS. 1–3, the size of item 18 is limited by the diameter of inner member 12. When larger items are to be placed into balloon 20, a larger diameter adapter member 34 is fitted onto end 24 of inner member 12. Instead of placing balloon end 20*a* over end 24 of inner member 12, balloon end 20*a* is now placed over end 34*a* of hollow member 34. Item 18 is placed within adapter member 34 before balloon end 20*a* is stretched over end 34*a* of adapter 34.

The second embodiment depicted in FIGS. 6 and 7 also includes a substantially hollow extension member 36 disposed within inner member 12 and partially within adapter member 34. Extension member 36 includes a substantially flat piston end 36*a* to make it easier to push item 18 into balloon 20.

In the second embodiment, the operation of the manual pump to inflate balloon 20 is the same as the operation of the manual pump described above in connection with FIGS. 2 through 5. However, item 18 is pushed into the inflated balloon in a slightly different manner, as depicted in FIG. 7.

After the balloon has been inflated, outer member 14 is removed and push rod 16 is inserted into inner member 12. Push rod 16 pushes hollow member 28 against extension member 36, so that piston 36*a* forces item 18 into inflated balloon 20 as depicted in FIG. 7 Open end 20*a* of balloon 20 is then tied to trap the air and item 18 within the balloon.

Figure 8:
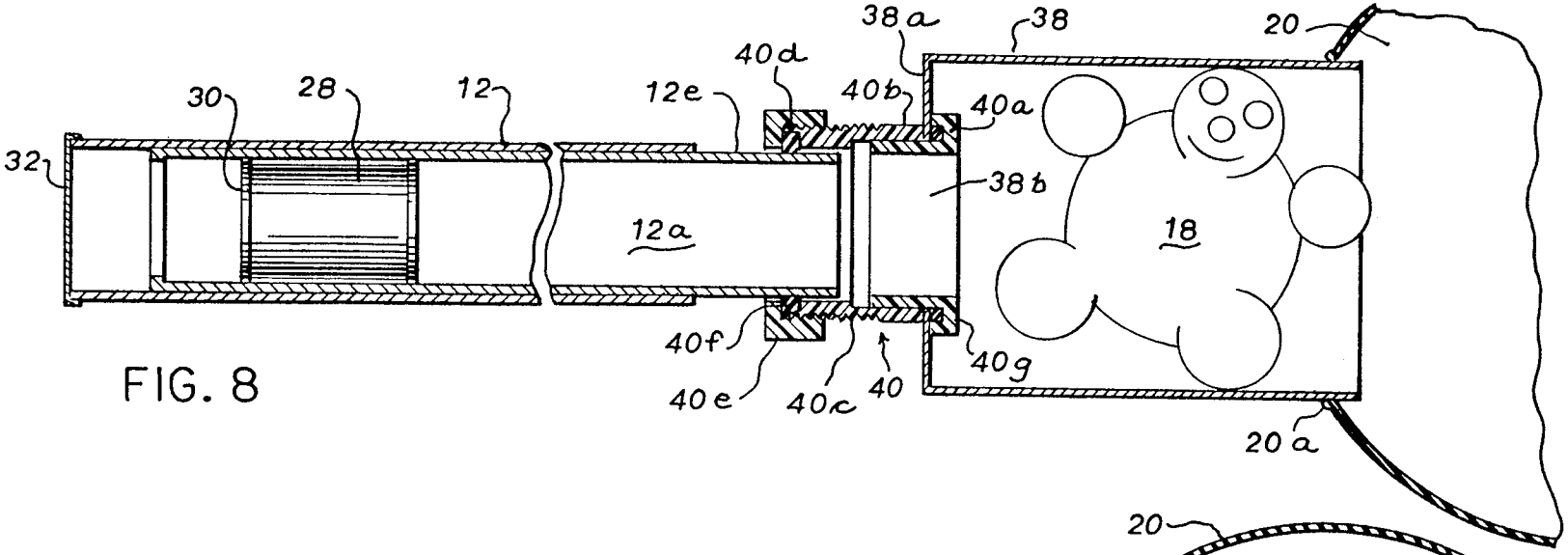
FIG. 8 is a side view, shown in partial section, of a third embodiment of the present invention employing a connector.
Figure 9:
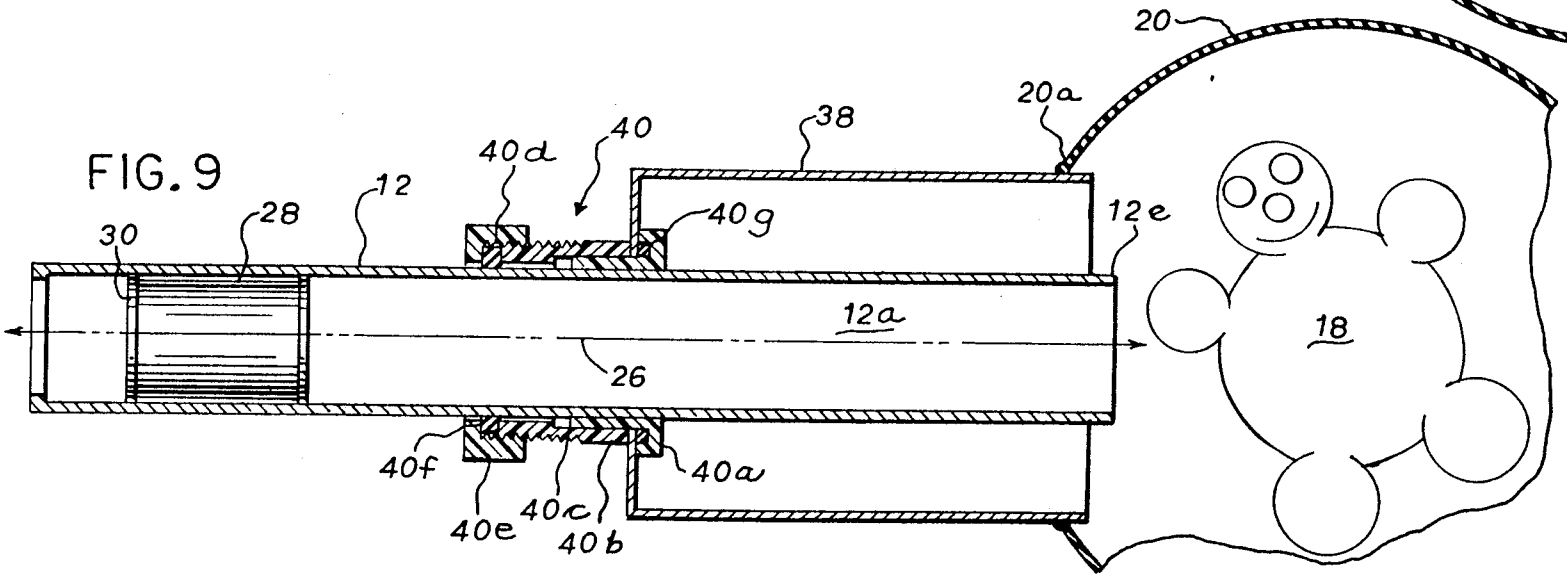
FIG. 9 is a side view, shown in partial section, of the third embodiment of FIG. 8 depicting the stuffing item being inserted into an inflated balloon.

FIGS. 8 and 9 depict a third embodiment of the present invention which eliminates the need for a separate push rod (FIGS. 1-3) to insert the item into the balloon as well as the need for an extension rod (FIGS. 6 and 7) as in the second embodiment. Although a check valve 30 is still required to prevent air from escaping inner member 12, check valve 30 may remain fixed and need not be slidable within inner member 12 in the third embodiment.

More specifically, the third embodiment of FIGS. 8 and 9 includes a substantially hollow adapter member 38 having an end 38*a* with an opening 38*b* therein. Adapter end 38*a* is in air flow communication with end 12*e* of inner member 12 by means of a connector 40.

Connector 40 includes a flange 40*a* that engages end 38*a* of hollow member 38. Connector 40 also includes a first connector member 40*b* having a first set of threads 40*c* on its outer surface. Threads 40*c* engage a second set of threads 40*d* formed on the inner surface of a nut connector 40*e*. A flexible air seal member 40*f* is disposed between connector member 40*b* and connector member 40*e* so that it engages both of the connector members. An O-ring seal 40*g* is disposed between flange 40*a* and end wall 38*a* to provide an air seal at the juncture between flange 40*a* and end wall 38*a*.

While the balloon is being inflated as depicted in FIG. 8, connector member 40*e* is screwed on so that its threads 40*d* tightly engage connector member 40*b* and its threads 40*c*. Connector member 40*e* is screwed on to prevent any air from escaping through connector 40.

After balloon 20 has been fully inflated as depicted in FIG. 9, nut connector 40*e* may be rotated to partially loosen its connection with connector member 40*b*. The loosening of this connection may allow a small amount of air to escape through connector 40. Inner member 12 is then moved in a direction parallel to its longitudinal axis 26 so that end 12*e* passes through connector 40 and into hollow member 38, thereby pushing item 18 into inflated balloon 20. Thus, inner member 12 acts as the push rod to push item 18 into balloon 20, thereby avoiding the need for a separate push rod.

Although several embodiments of the invention have been depicted and described, other embodiments will be apparent to those skilled in the art and are within the intended scope of the present invention. Therefore, the invention is to be limited only by the following claims.

I claim:

1. A balloon stuffing device, comprising:

an inner hollow member having a longitudinal axis and adapted to receive a balloon stuffing item therein;

an outer hollow member that receives a portion of said inner hollow member;

a sliding valve disposed and movable within said inner hollow member;

a second valve interconnected with said outer hollow member; and means for moving said sliding valve within said inner hollow member.

2. The balloon stuffing device of claims 1, further comprising:

a third hollow member disposed within said inner hollow member that is interconnected with said sliding valve and movable with said sliding valve.

3. The balloon stuffing device of claim 2, wherein said third hollow member is a cylinder.

4. The balloon stuffing device of claim 1, further comprising:

a hollow adapter that fits over a first end of said inner hollow member and that is adapted to receive said balloon stuffing item; and an extension member disposed in said inner hollow member between said sliding valve and said balloon stuffing item.

5. The balloon stuffing device of claim 4, wherein said adapter is substantially cylindrical.

6. The balloon stuffing device of claim 4, wherein said extension member is a push rod.

7. The balloon stuffing device of claim 1, wherein said sliding valve is a check valve.

8. The balloon stuffing device of claim 1, wherein said second valve is a check valve.

9. The balloon stuffing device of claim 1, wherein said inner hollow member and said outer hollow member have substantially cylindrical shapes.

10. The balloon stuffing device of claim 1, wherein said movement means is a push rod.

* * * * *